US009151058B1

(12) United States Patent
Leathe

(10) Patent No.: US 9,151,058 B1
(45) Date of Patent: Oct. 6, 2015

(54) LEDGER BOARD BRACKET

(76) Inventor: Brian Leathe, Haverhill, MA (US)

( * ) Notice: Subject to any disclaimer, the term of this patent is extended or adjusted under 35 U.S.C. 154(b) by 133 days.

(21) Appl. No.: 13/489,630

(22) Filed: Jun. 6, 2012

Related U.S. Application Data

(60) Provisional application No. 61/494,047, filed on Jun. 7, 2011.

(51) Int. Cl.

| | |
|---|---|
| ***E04C 2/38*** | (2006.01) |
| ***E04D 13/15*** | (2006.01) |
| ***E04F 19/06*** | (2006.01) |
| ***E04B 1/00*** | (2006.01) |
| ***E04B 1/64*** | (2006.01) |

(52) U.S. Cl.
CPC ..... *E04D 13/15* (2013.01); *E04B 1/003* (2013.01); *E04B 1/64* (2013.01); *E04F 19/061* (2013.01)

(58) Field of Classification Search
CPC ..... E04D 13/15; E04F 19/061; E04F 19/062; E04B 5/00; E04B 1/003; E04B 1/64
USPC ..... 52/702, 704, 712, 742.15, 547, 698, 52/837; 248/214, 300, 248; 403/232.1, 403/187; 211/13.1, 182
See application file for complete search history.

(56) References Cited

U.S. PATENT DOCUMENTS

| | | | | | |
|---|---|---|---|---|---|
| 1,855,241 | A | * | 4/1932 | Irwin | 248/48.2 |
| 1,945,925 | A | * | 2/1934 | Stiefel | 403/2 |
| 3,129,819 | A | * | 4/1964 | Chandler | 211/50 |
| 4,013,253 | A | * | 3/1977 | Perrault et al. | 248/222.51 |
| 4,039,137 | A | * | 8/1977 | Smith | 248/248 |
| 4,124,962 | A | | 11/1978 | Lancelot, III et al. | |
| 4,223,866 | A | | 9/1980 | Black | |
| 4,422,792 | A | | 12/1983 | Gilb | |
| 4,584,813 | A | | 4/1986 | Hudson | |
| 4,659,047 | A | * | 4/1987 | Haller | 248/274.1 |
| 4,953,339 | A | | 9/1990 | Jewell | |
| 5,058,358 | A | | 10/1991 | Stratton | |
| 5,100,090 | A | * | 3/1992 | Drower | 248/248 |
| 5,201,156 | A | | 4/1993 | Newman | |
| 5,257,766 | A | * | 11/1993 | Riblet | 248/248 |
| 5,419,649 | A | * | 5/1995 | Gilb | 403/231 |
| 6,311,449 | B1 | | 11/2001 | Morse et al. | |
| 6,397,552 | B1 | | 6/2002 | Bourque | |
| 6,817,157 | B2 | | 11/2004 | Bourque | |
| 6,945,004 | B1 | | 9/2005 | Ghiringhelli | |
| 7,254,926 | B2 | | 8/2007 | Eldeen | |
| 7,429,023 | B2 | | 9/2008 | Morrow | |
| 7,503,148 | B2 | * | 3/2009 | Lin | 52/643 |
| 2005/0066613 | A1 | | 3/2005 | Bourque | |
| 2005/0160683 | A1 | | 7/2005 | Eldeen | |
| 2006/0130414 | A1 | | 6/2006 | Walther | |

(Continued)

*Primary Examiner* — Korie H Chan
(74) *Attorney, Agent, or Firm* — Anderson Gorecki & Roville LLP

(57) ABSTRACT

A ledger board bracket includes a ledger board receiving section defined having a channel extending along its length to provide an offset between a ledger board and a building when the ledger board is mounted to the building in connection with installation of a deck. An integral flange may be incorporated to help direct water away from entering the channel. A joist hanger may be implemented on a front surface of the ledger board bracket to enable the ledger board bracket to implement a combination ledger board and joist hanger bracket. Apertures may be provided in the bracket to enable fasteners to pass through the bracket in connection with mounting the ledger board to the building and in connection with securing the joists to the ledger board.

13 Claims, 5 Drawing Sheets

(56) References Cited

U.S. PATENT DOCUMENTS

2008/0005975 A1* 1/2008 Thompson ..... 52/62
2008/0202059 A1 8/2008 McCollough
2009/0056235 A1* 3/2009 Morsching ..... 52/58
2011/0079693 A1* 4/2011 Burkman ..... 248/224.8
2011/0107710 A1* 5/2011 Sias ..... 52/655.1

* cited by examiner

LEDGER BOARD BRACKET

CROSS-REFERENCE TO RELATED APPLICATIONS

This application claims priority to provisional patent application No. 61/494,047, filed Jun. 7, 2011, the content of which is hereby incorporated herein by reference.

BACKGROUND OF THE INVENTION

1. Field of the Invention

The present invention relates to construction brackets and, more particularly, to a bracket used to connect a ledger board to a building.

2. Description of the Related Art

When a deck is to be constructed on a building, a board referred to as a ledger board is first connected to the building. The ledger board provides a secure location to join all of the joists of the deck to the building, so that the deck may be strongly constructed and securely connected to the building.

Installation of a ledger board may be a time consuming task. Generally, if the building has been sided, the siding is removed from the building in the area where the ledger board is to be connected to the building. The ledger board will then be held in place and connected to the frame of the building, e.g. to the sill or studs, using structural flat-headed bolts. The ledger board will then be flashed to minimize the amount of moisture that is able to get between the ledger board and the building, and the original siding or replacement siding will be put back onto the building to prevent moisture from being able to enter the building. This process takes a considerable amount of time. Accordingly, it would be advantageous to provide a new way of installing a deck on new or previously constructed buildings.

SUMMARY OF THE INVENTION

A ledger board bracket includes a ledger board receiving section defined having a channel extending along its length to provide an offset between a ledger board and a building when the ledger board is mounted to the building in connection with installation of a deck. An integral flange may be incorporated to help direct water away from entering the channel. A joist hanger may be implemented on a front surface of the ledger board bracket to enable the ledger board bracket to implement a combination ledger board and joist hanger bracket. Apertures may be provided in the bracket to enable fasteners to pass through the bracket in connection with mounting the ledger board to the building and in connection with securing the joists to the ledger board.

BRIEF DESCRIPTION OF THE DRAWINGS

Aspects of the present invention are pointed out with particularity in the appended claims. The present invention is illustrated by way of example in the following drawings in which like references indicate similar elements. The following drawings disclose various embodiments of the present invention for purposes of illustration only and are not intended to limit the scope of the invention. For purposes of clarity, not every component may be labeled in every figure. In the figures:

DETAILED DESCRIPTION

The following detailed description sets forth numerous specific details to provide a thorough understanding of the invention. However, those skilled in the art will appreciate that the invention may be practiced without these specific details. In other instances, well-known methods, procedures, components, and dimensions, have not been described in detail so as not to obscure the invention.

The bracket is designed to hold a ledger board on a building such as a house or apartment building. As used herein, the term "building" will be used as a generic term for a structure where a deck is to be installed. The term building thus is being used to refer generically to a residential house, apartment, townhouse, or other residence, an out building such as a shed or garage, a commercial building, or any other place where it may be desirable to install a deck or other structure requiring a ledger board to be fastened to an existing structure.

In some embodiments, the design of the bracket enables the ledger board to be installed over the existing siding on the building so that it is not necessary to remove the existing siding or exterior wall coverings prior to installation of the ledger board. This greatly accelerates installation of the ledger board to reduce the overall cost of installing a deck on a building.

Referring generally to FIGS. 1-5, the bracket 10 is designed to retain and facilitate attachment of a ledger board, or other elongate flat object, to a building. For example in connection with installing a deck, the bracket may be used to help attach a 2×8 or 2×10 piece of pressure treated lumber that will act as the ledger board for the deck. Where a different structural component is to be used as the ledger board, the bracket may be sized accordingly to accommodate the dimensions of the component intended to be used as the ledger board. In the embodiments shown in FIGS. 1-3, the bracket 10 has a rear section 12 designed to engage the building, a lower section 14 sized to extend out along a lower edge of the ledger board, and a front section 16 to extend at least part way up the front of the ledger board.

Figure 1:
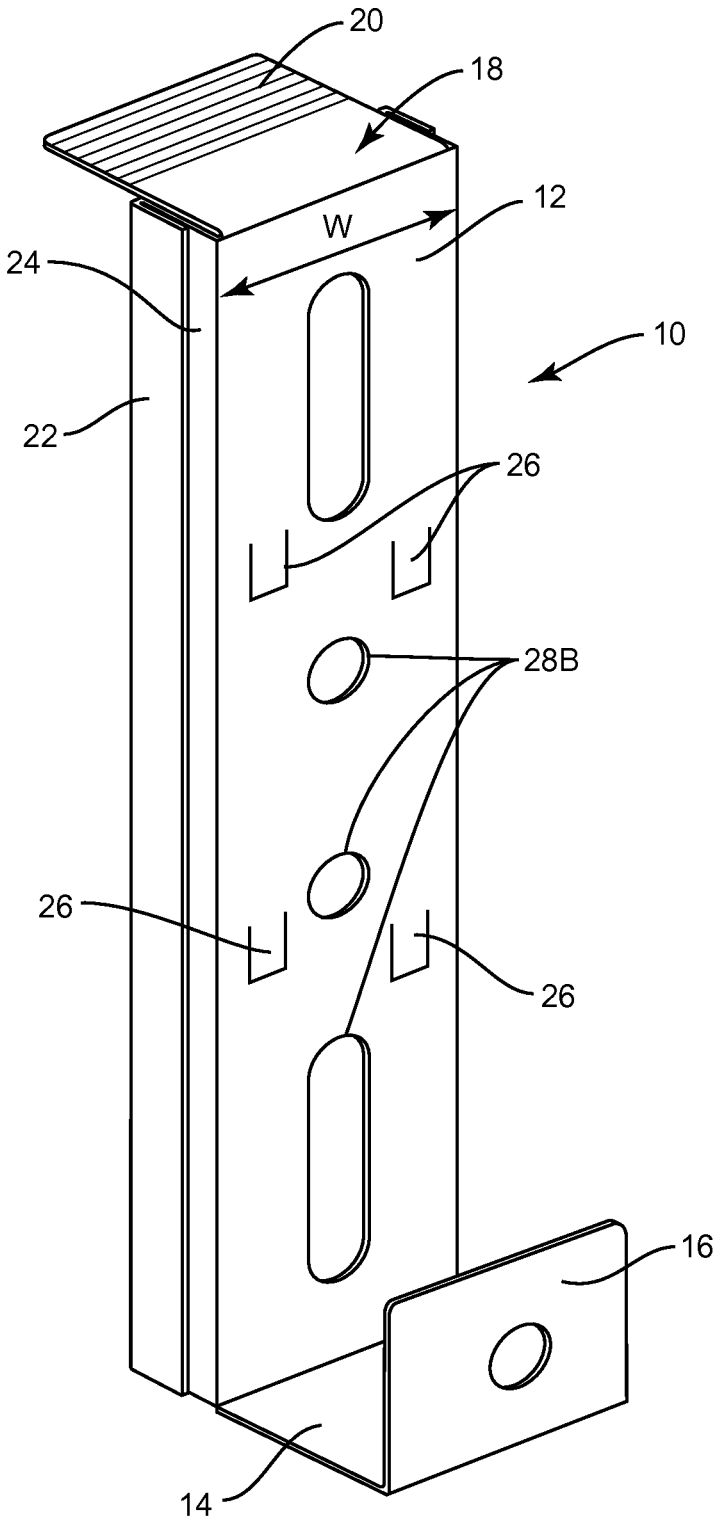
FIG. 1 is a front perspective view of a first embodiment of a ledger board bracket.
Figure 3:
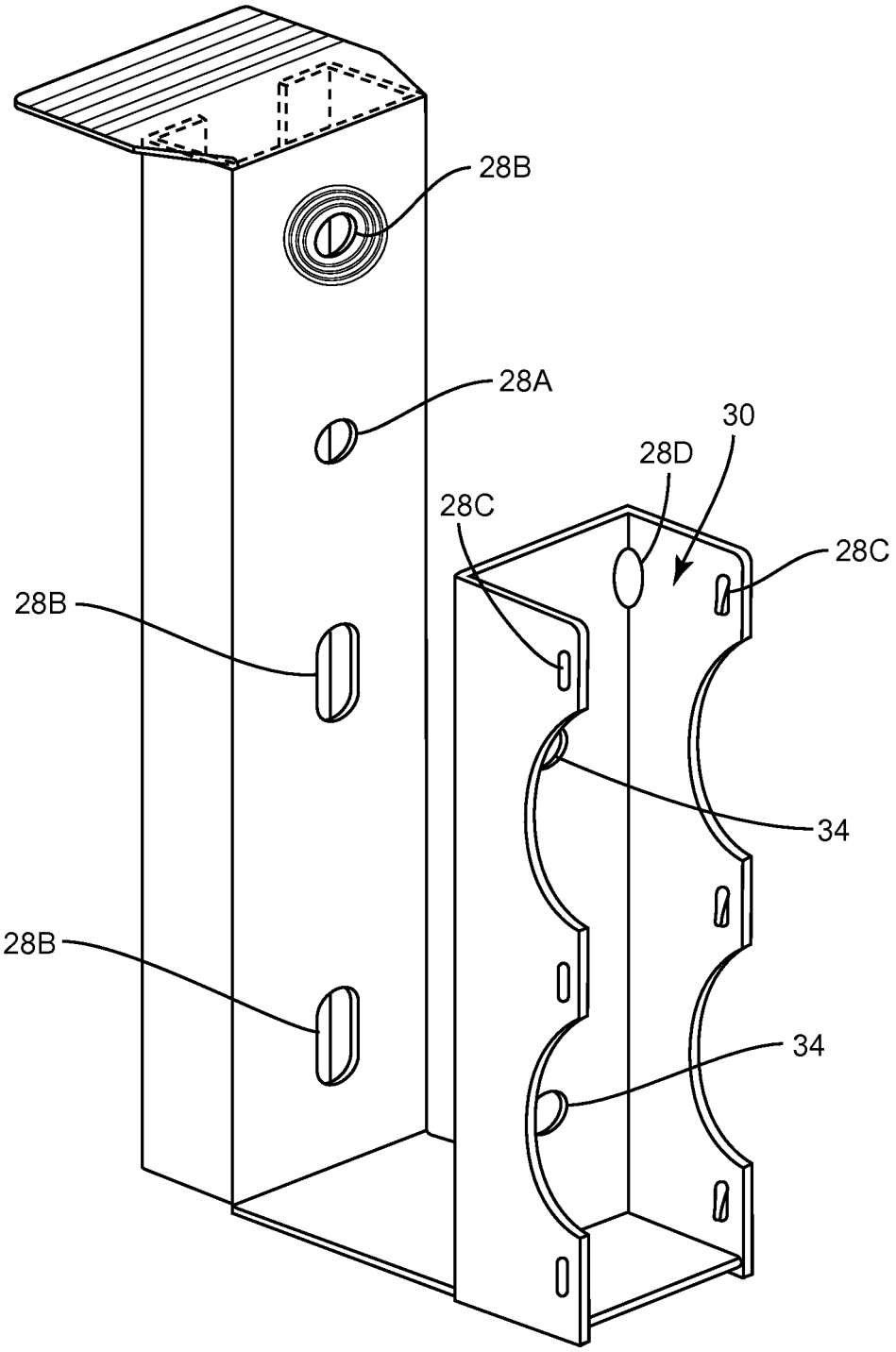
FIG. 3 is a front perspective view of a third embodiment of a ledger board bracket.

The rear section 12, lower section 14, and front section 16 may be sized differently to accommodate differently sized ledger boards. For example, if the bracket is to be used with a 2×8 ledger board, the bottom section may be approximately 1.5 inches long and the rear section may be about 7.5 inches long to coincide with the standard dimensions of a standard 2×8. To accommodate a 2×10 ledger board, the rear section may be increased to be approximately 9.25 inches long to enable the dimensions of the bracket to approximately coincide with the dimensions of a standard 2×10. The front section may vary in length depending on the embodiment. For example, the front section may be relatively short as shown in FIG. 1, may be designed to extend further up the ledger board, as shown in FIG. 3, or optionally the front may be the same length as the rear section 12 of the bracket.

Figure 4:
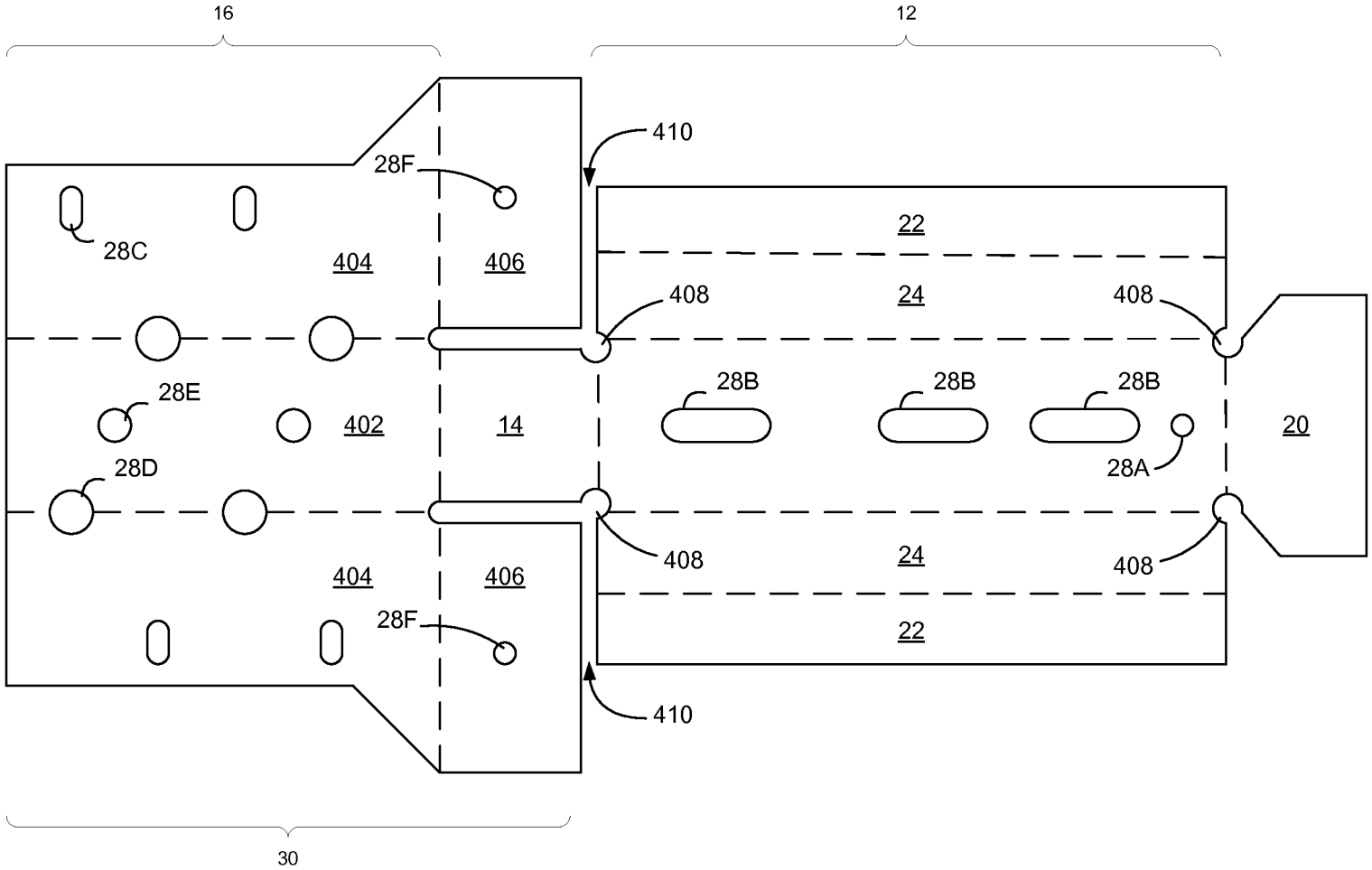
FIG. 4 shows a front view of an example ledger board bracket blank according to an embodiment before the bracket blank has been bent to form a bracket similar to the embodiment shown in FIG. 3.
Figure 5:
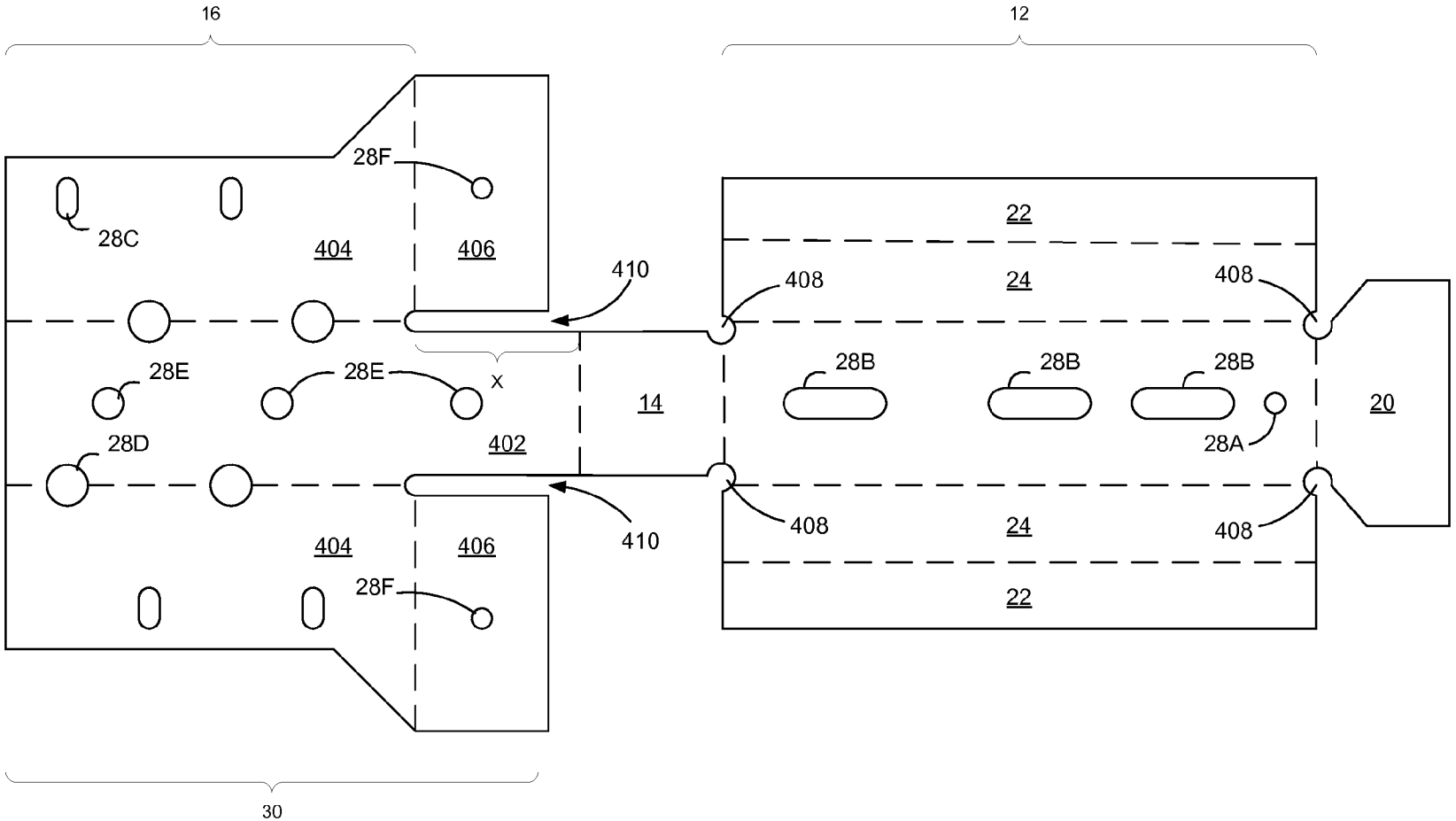
FIG. 5 shows a front view of another embodiment of a ledger bracket blank according to an embodiment before the bracket blank has been bent to form a bracket.

The bracket may be formed from steel, plastic, or other structural material. In one embodiment, the bracket may be formed of 16, 18, or 20 gauge galvanized steel. In environments where corrosion is problematic, such as along the sea coast, stainless steel, plastic, or aluminum may be used to provide additional longevity. Other materials may be used as well. Preferably, the bracket is stamped out of flat material and bent into the desired shape. For example, FIGS. 4 and 5 show example bracket blanks that may be stamped out of material and bent into ledger board brackets according to an embodiment. Optionally, depending on the configuration, one or more of the seams between sections or pieces of material may be spot welded. Other manufacturing techniques may be used to create the bracket as well.

The bracket 10 has a channel 18 defined on the rear section, for example along the length of the rear section. In operation, when the ledger bracket is installed, the channel 18 will extend between a ledger board that is cradled by the rear, lower and front sections of the bracket, and the building. The channel provides approximately a ½ to ¾ inch stand-off between the ledger board and building so that air circulation will prevent water from being trapped by the ledger board against the building. This allows the siding to remain on the building so that the siding is not required to be removed from the building prior to installation of the ledger board. Since the siding is not removed, the natural characteristics of the siding/exterior finish are allowed to shed water to maintain the waterproof integrity of the building. Further, this speeds up installation of the ledger board, which can result in significant overall time savings.

The channel itself is open to allow air to circulate within the channel. Allowing air to circulate helps to keep the area within the channel dry. In one embodiment, as shown in FIGS. 1 and 3, the bracket 10 has a top flashing flange 20 that may be trimmed off or bent up at the appropriate length to help direct water away from entering the channel. If desired, an additional bead of silicone may be added along the top edge where the flashing flange meets the building in connection with installation of the ledger board or deck to seal the flashing flange to the wall.

Figure 2:
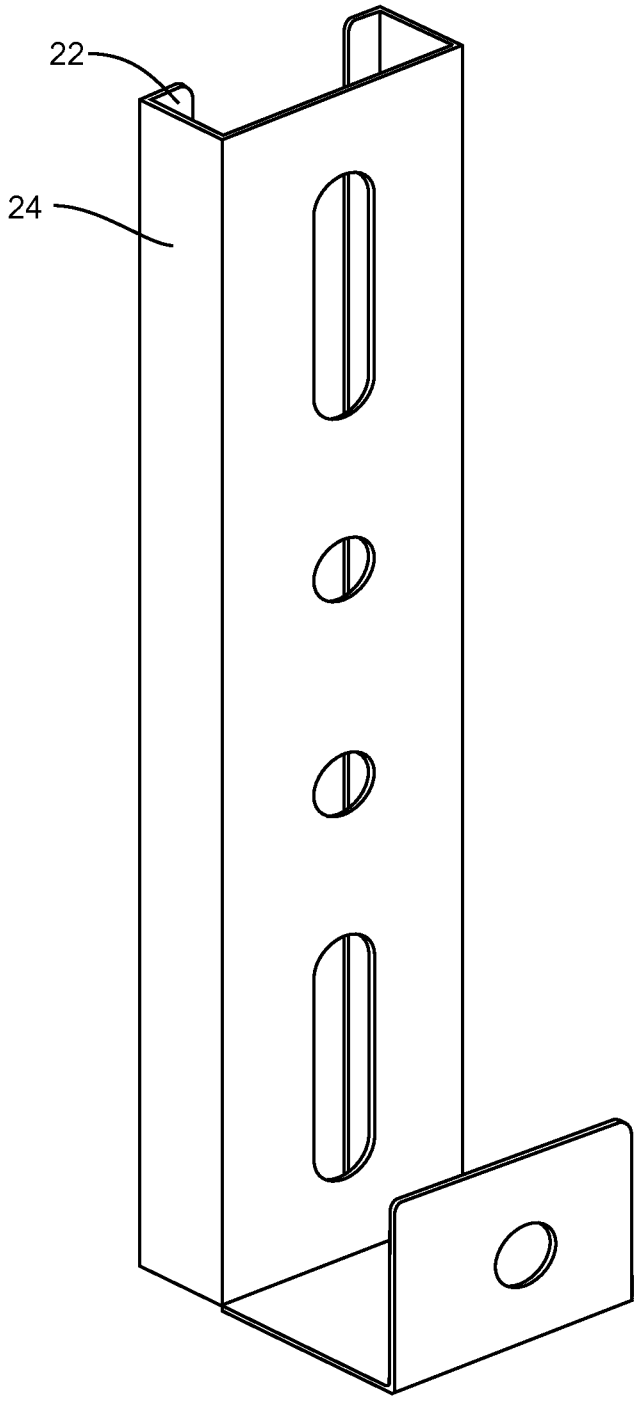
FIG. 2 is a front perspective view of a second embodiment of a ledger board bracket.

The channel may be formed in several ways. For example, as shown in FIG. 1, the channel may be formed by bending the edges 22 of the bracket to double-back on side walls 24. Alternatively, as shown in FIGS. 2-3, the edges may be folded at approximately a 90 degree angle relative to side walls 24 to extend into the channel. Optionally, (not shown) the edges 22 may be folded in the opposite direction to extend outward away from the channel at an approximately 90 degree angle relative to the side walls 24. Folding the edges at 90 degree angles relative to the side-walls 24 provides a greater surface area at the location where the bracket contacts the building to distribute compressive load associated with attaching the bracket to the house over a larger surface area.

The dimensions of the side-walls 24 and edges 22 forming the structural walls of the channel may be designed according to preference depending on the intended dimensions of the channel. In one embodiment, the side-walls 24 are between approximately ⅜ to ⅝ inch wide and extend the length of the rear section 12. In one embodiment, the edges 22 are between approximately ¼ and ½ inch wide and also extend the length of the rear section. Dimensioned in this manner, the rear channel is approximately ½ inch deep to allow the ledger board to have a gap of approximately ½ inch between the building and the ledger board when installed. Other dimensions may be used for the side walls 24 and edges 22 and the dimensions provided herein are merely recited as preferable ranges for implementation of a particular embodiment. Likewise, other embodiments may have the side-walls 24 and edges 22 not extend the entire length of the rear section 12 depending on the implementation. The overall width W of the bracket (see FIG. 1) may be on the order of between 2 and 4 inches, although other sized brackets may be formed as well.

Optionally, as shown in FIG. 1, flaps 26 may be cut in rear section 12 and folded into the channel to provide additional lateral stability to the side-walls 24 to help prevent the side-walls from bending relative to the bracket during installation and once the deck is in place. Flaps 26 may be omitted if desired depending on the particular implementation. Indeed, although shown on the example illustrated in FIG. 1, the flaps 26 may be omitted from this embodiment as well without departing from the scope of the invention.

Multiple apertures 28 may be designed into the bracket to enable fasteners to be used in connection with the bracket. For example, fasteners may be used to initially mount the bracket to the building, to enable fasteners to pass through the bracket in connection with fastening the ledger board to the building, and to enable fasteners to pass through the bracket in connection with fastening the joist to the ledger board. The selection of apertures may vary depending on the particular implementation and the invention is thus not limited to an embodiment using the particular selection of apertures illustrated in the figures. Optionally the region surrounding one or more of the apertures may be dimpled to provide a recessed area in which to fit the head of a fastener when installed in the bracket. Dimpling enables an outer surface of the fastener to be more aligned with the surface of the bracket to reduce interference between the fastener head and an adjacent piece of wood (joist or ledger board) supported by the bracket.

During installation, brackets are connected onto a wall of the building or other structure where the deck is to be installed. An initial fastener may be used to hold the bracket in place on the wall of the building. As shown in FIG. 4, aperture 28A may be incorporated into the bracket and sized to receive a suitable initial fastener. The initial fastener may be a mounting screw, nail, or other fastener designed to temporarily or permanently hold the bracket in position on the wall of the structure. Where multiple brackets are to be used to support the ledger board, the brackets may be lined up to be level and preferably are arranged approximately every 12 to 16 inches in a line along the wall where the ledger board is to be installed. For example, brackets may be placed along the wall every 16 inches on center to enable the mounting fasteners to extend through the bracket and into a stud of the building or into the sill of the building. The particular placement of the brackets will depend on how the building to which the deck is being attached has been constructed, the location of the ledger board relative to the structural components of the building, as well as local building codes. The invention is not limited by the particular manner selected to arrange the brackets on the building. Alternatively, the ledger brackets may be initially attached to the ledger board using the initial fastener and then the ledger board and brackets may be attached as a unit to the building.

Once the brackets have been initially fastened to the building, a ledger board is placed into the brackets and held in place via lower section 14 and front section 16. Fasteners, such as structural mounting bolts, are then bolted through the ledger board and apertures 28B. Where the front 16 extends significantly up the length of the bracket, corresponding holes 28E may be provided to enable structural fasteners to pass through the front of the bracket. Optionally, the location where fasteners are to be used to mount the ledger board to the building may be marked onto the ledger board using another bracket as a template.

Preferably at least two structural bolts or other sturdy fasteners should be used to hold the ledger board to the wall, although the precise installation method may vary according to local building codes. The particular method used to connect the ledger board to the building should be selected to enable the ledger board to be safely connected to the building. For example, the mounting method may be designed and laid out to enable the fasteners being used to connect the ledger board to the building to penetrate the band, rim, or header joist located at floor level of the building. If no band, rim, or header-joist exists, then the brackets preferably would be aligned with the structural studs located in the wall to provide a relatively secure connection between the ledger board and the structural members used to construct the building to which the deck is to be attached. Selection of where to use the brackets in connection with building a deck is mainly concerned with preventing the ledger board from becoming detached from the building while the deck is in use and doesn't affect the structure of the bracket itself. Although the preferred method of mounting the ledger board to the building is to cause the fasteners to pass through the bracket, other methods may be used as well in which some or all of the structural fasteners used to secure the ledger board to the building do not pass through the brackets.

In one embodiment, as shown in FIG. 3, the front section 16 may have a built-in joist hanger bracket 30. FIGS. 4 and 5 show bracket blanks that may be stamped out and bent to form a bracket that incorporates both a ledger board bracket and a joist hanger bracket. As shown in FIG. 3, the joist hanger bracket includes a joist hanger back panel sized to lie adjacent a butt end of a joist and a pair of side panels designed to extend part way along sides of the joist. One or more joist hanger bottom panels are provided to support the butt end of the joist prior to fastening the joist to the ledger board.

Joist connection apertures 28C may be provided to enable the joist hanger bracket to be secured to a joist and to enable the fasteners to pass through the joist hanger and joist to secure the joist to the ledger board. The joist connection apertures 28C in FIG. 4 have been configured to be oval in nature to allow a fastener such as a nail or deck screw to be inserted through the material forming the bracket at an angle. This allows the fasteners to extend through a joist to exit a corresponding exit aperture 28D to engage the ledger board. For example, in FIG. 3, a fastener inserted through top joist connection aperture 28C would extend through a joist (not shown) and exit through exit aperture 28D into a ledger board supported by the ledger board bracket (also not shown). Although nails are commonly used as fasteners to secure a joist to a ledger board, other fasteners such as screws may be used as well and the invention is not limited by the type of fastener selected to be used to install the ledger boards and joist while using the ledger bracket described herein. Apertures 28E may be provided in the front section of the ledger board bracket, for example in the portion of the front section in which the joist hanger is implemented. Having one or more fasteners extend through the joist hanger bracket assists in securing the joist hanger bracket to the ledger board when mounting the ledger board on the building.

FIG. 4 shows an example blank that may be bent to implement an embodiment. In FIG. 4, joist hanger side panels 404 fold approximately perpendicular to joist hanger back panel 402 to form sides of the joist hanger. Joist hanger bottom panels 406 of bracket blank (FIG. 4) fold approximately perpendicular to joist hanger side panels 404 to form the bottom of the joist hanger. Optionally, joist hanger bottom panels 406 may be spot welded together. Alternatively, apertures 28F may be formed in joist hanger bottom panels 406 and spaced such that upon folding of bracket blank to form the joist hanger, the apertures 28F of the two bottom panels 406 are approximately in line with each other. Optionally a screw or other fastener may then be extended through the apertures 28F to secure the joist hanger bottom panels 406 relative to each other. Other designs for the bottom of the joist hanger may be implemented as well depending on the embodiment.

Although FIG. 3 shows the joist hanger bracket 30 formed toward the bottom of the bracket 10, so that the bottom of joist hanger bracket is level with the bottom of the ledger board, in other embodiments the joist hanger bracket may be formed further up the front section 16. To do this, section 402 of FIG. 4 may be extended as shown in FIG. 5 to cause the bottom of the joist hanger, formed from joist hanger bottom panels 406, to be displaced a distance X up the front of the ledger board bracket. This provides distance X between the bottom of the joist hanger formed using sections 406 and the bottom 14 of ledger board receiving area to enable the top of joist to be displaced a distance X upward relative to the ledger board. The precise location of the bottom of joist hanger bracket relative to the ledger board may be selected depending on the sizes of the ledger board and joists to be used to form the deck. For example, if the ledger board is designed to accommodate a 2×10 ledger board and the joists are intended to be formed from 2×8 pressure treated wood, the bottom of the joist hanger bracket may be formed approximately 2 inches (X=2") above the level of the bottom section 14 so that, in use, the top of the joists will be approximately level with the top of the ledger board.

FIG. 4 shows a front view of an example ledger bracket blank according to an embodiment before the bracket blank has been bent to form the bracket. The dimensions of the various pieces shown in the bracket blank of FIG. 4 are not drawn to scale. In the view shown in FIG. 4, the dashed lines indicate approximate locations where bends in the metal would be expected to occur to enable the blank to be formed into a bracket similar to the embodiment shown in FIG. 3. Cut-out sections 408 shown as generally circular in nature may optionally be implemented in regions where multiple fold lines intersect with slots 410 cut in the bracket blank. Various optimizations to the particular manner the bracket is configured to enable manufacturing to occur would be apparent to a person of ordinary skill in the art, and the blank illustrated in FIG. 4 is intended merely to provide an example of how a blank may be created to implement both a joist bracket and a ledger bracket as described herein.

FIG. 5 shows a front view of another example ledger bracket blank according to an embodiment, in which the joist hanger is designed to cradle a joist that is smaller than the ledger board as described in greater detail above.

As discussed in greater detail above, the bracket, according to an embodiment, eliminates the need to remove exterior wall covering surface which greatly reduces the cost of installing the ledger board when a deck is to be added to an existing structure. The bracket is instrumental in hanging a deck ledger board which is an intricate part of building a deck, and eliminates numerous steps in traditional deck building design. The bracket is designed for use with 2 inch 51 mm nominal lumber and may be implemented using single piece multiple bent construction design. The ledger board bracket has ½ proper wall spacing which allows for air flow between the ledger board and structure. Built in flashing eliminates the need to flash and counter flash, and the open concept eliminates moisture build up. The bracket may be formed to include a built-in joist hanger and provides apertures for use with structural fasteners that provides proper fastener spacing.

It should be understood that various changes and modifications of the embodiments shown in the drawings and described in the specification may be made within the spirit and scope of the present invention. Accordingly, it is intended that all matter contained in the above description and shown in the accompanying drawings be interpreted in an illustrative and not in a limiting sense. The invention is limited only as defined in the following claims and the equivalents thereto.

What is claimed is:

1. A ledger board bracket, comprising:

a ledger board channel formed from front, lower, and rear sections which form a first trough that is open on the top, left, and right sides of the ledger board bracket, the ledger board channel being adapted to receive a ledger board when a length of the ledger board is oriented horizontally; and an air circulation channel extending from top to bottom along the rear section of the ledger board channel, the air circulation channel including side walls which form a vertically oriented channel that is open on the top, bottom, and rear sides of the ledger board bracket; and a top flashing configured to help direct water away from entering the air circulation channel, and wherein the air circulation channel is vertically oriented so that any water that does enter the air circulation channel is able to drip out of the air circulation channel without pooling within the air circulation channel.

2. The ledger board bracket of claim 1, wherein the rear section is dimensioned to approximately coincide with a width of the ledger board, and wherein the air circulation channel is formed along and extends the length of the rear section.

3. The ledger board bracket of claim 1, wherein the air circulation channel has a pair of side walls extending approximately perpendicular from the rear section and a pair of edges bent approximately perpendicular from the side walls, the side walls providing a contact surface between the ledger board bracket and a building once the ledger board bracket is installed on a building.

4. A ledger board bracket, comprising:

a ledger board channel formed from front, lower, and rear sections which form a first trough that is open on the top, left, and right sides of the ledger board bracket, the ledger board channel being adapted to receive a ledger board when a length of the ledger board is oriented horizontally; and an air circulation channel extending from top to bottom along the rear section of the ledger board channel, the air circulation channel including side walls which form a vertically oriented channel that is open on the top, bottom, and rear sides of the ledger board bracket;

wherein the air circulation channel has a pair of side walls extending approximately perpendicular from the rear section and a pair of edges bent to double back along the side walls.

5. The ledger board bracket of claim 1, further comprising a joist hanger formed integral with the ledger board bracket.

6. The ledger board bracket of claim 5, wherein the joist hanger is formed from side walls and a bottom wall which form a horizontally oriented trough that is open on the top and front sides to receive and retain a joist to enable the joist to be secured to the ledger board.

7. A ledger board bracket, comprising:

a ledger board channel formed from front, lower, and rear sections which form a first trough that is open on the top, left, and right sides of the ledger board bracket, the ledger board channel being adapted to receive a ledger board when a length of the ledger board is oriented horizontally; and an air circulation channel extending from top to bottom along the rear section of the ledger board channel, the air circulation channel including side walls which form a vertically oriented channel that is open on the top, bottom, and rear sides of the ledger board bracket; and a joist hanger formed integral with the ledger board bracket;

wherein the joist hanger is formed from side walls and a bottom wall which form a horizontally oriented trough that is open on the top and front sides to receive and retain a joist to enable the joist to be secured to the ledger board wherein the joist hanger has fastening apertures and exit apertures to enable fasteners to extend through the joist hanger and joist and into the ledger board to secure the joist to the ledger board.

8. A ledger board bracket, comprising:

a ledger board channel formed from front, lower, and rear sections which form a first trough that is open on the top, left, and right sides of the ledger board bracket, the ledger board channel being adapted to receive a ledger board when a length of the ledger board is oriented horizontally; and an air circulation channel extending from top to bottom along the rear section of the ledger board channel, the air circulation channel including side walls which form a vertically oriented channel that is open on the top, bottom, and rear sides of the ledger board bracket;

wherein the rear section has a plurality of rear apertures sized to enable fasteners inserted through the ledger board to pass through the rear section of the ledger bracket to structurally secure the ledger board to the building.

9. The ledger board bracket of claim 8, wherein the front section has at least one front aperture sized to enable at least one fastener to pass through the front of the ledger bracket prior to insertion through the ledger board.

10. The ledger board bracket of claim 9, wherein the front aperture is approximately aligned with at least one of the plurality of rear apertures.

11. The ledger board bracket of claim 10, wherein the rear aperture is larger than the front aperture.

12. The ledger board bracket of claim 8, wherein at least one of the plurality of rear apertures is dimpled.

13. A ledger board bracket having top, bottom, front, back, left, and right sides, the ledger board bracket comprising:

a ledger board channel formed from a first section facing the front of the ledger board bracket, a second section facing the bottom of the ledger board bracket, and a third section facing the back of the ledger board bracket, the first, second, and third sections defining a first horizontally oriented trough that is open toward the top, left, and right sides of the ledger board bracket, the first horizontally oriented trough being adapted to receive a ledger board when a length of the ledger board is oriented horizontally;

an air circulation channel extending from top to bottom along the third section of the ledger board channel at the back of the ledger board bracket, the air circulation channel having a fourth section facing the left of the ledger board bracket and a fifth section facing the right of the ledger board bracket, the fourth section and the fifth section defining a second vertically oriented trough that is open toward the top, back, and bottom sides of the ledger board bracket; and a joist hanger channel extending from the first section of the ledger board channel, the joist hanger channel including a sixth section facing the left of the ledger board bracket, a seventh section facing the right of the ledger board bracket, and an eighth section facing the bottom of the ledger board bracket, the sixth, seventh, and eighth sections defining a third horizontally oriented trough that is open toward the top and front sides of the ledger board bracket.

* * * * *